United States Patent [19]

Shovar

[11] Patent Number: 4,792,189

[45] Date of Patent: Dec. 20, 1988

[54] SEAT ASSEMBLY

[76] Inventor: John S. Shovar, 4103 W. Lombard, Davenport, Iowa 52804

[21] Appl. No.: 152,108

[22] Filed: Feb. 4, 1988

[51] Int. Cl.[4] ..... A47C 7/02

[52] U.S. Cl. ..... 297/452; 297/444; 297/DIG. 1; 297/DIG. 2

[58] Field of Search ..... 297/452, 445, 444, DIG. 2, 297/DIG. 1, 440

[56] References Cited

U.S. PATENT DOCUMENTS

| | | | |
|---|---|---|---|
| 3,281,185 | 10/1966 | Albinson | 297/452 |
| 3,298,743 | 1/1967 | Albinson | 297/455 |
| 3,300,251 | 1/1967 | Helms | 297/455 |
| 3,328,085 | 6/1967 | Schwartz | 297/452 |
| 3,423,775 | 1/1969 | Cockerill | 5/353.1 |
| 3,521,929 | 7/1970 | Pearson | 297/454 |
| 3,647,260 | 3/1972 | Grant | 297/219 |
| 3,713,697 | 1/1973 | Koepke | 297/456 |
| 3,823,980 | 7/1974 | Harnick | 297/455 |
| 3,904,242 | 9/1975 | Koepke | 297/452 |
| 3,967,852 | 7/1976 | Eiselt | 297/452 |
| 4,018,479 | 4/1977 | Ball | 297/455 |
| 4,123,105 | 10/1978 | Frey | 297/DIG. 1 |
| 4,275,925 | 6/1981 | Harder, Jr. | 297/444 |
| 4,357,723 | 11/1982 | Zelkowitz | 297/452 |
| 4,390,210 | 6/1983 | Wisnewski et al. | 297/444 |
| 4,643,480 | 2/1987 | Morita | 297/452 X |

*Primary Examiner*—James T. McCall

[57] ABSTRACT

A novel seat assembly is disclosed including a foam cushion assembly, a rigid shell, a cover and means for holding the components in assembled relation. The cushion assembly comprises a foam cushion, including a peripheral lip extending around the side of the cushion, and an internal rigid framework located to maintain the predetermined configuration of the lip. The shell has an edge configured to align and mate with the cushion lip. The cover overlies the front of the cushion with its free peripheral section extending between the cushion lip and the shell edge. The cushion assembly is rotatably mounted to the shell.

3 Claims, 3 Drawing Sheets

FIG. 3
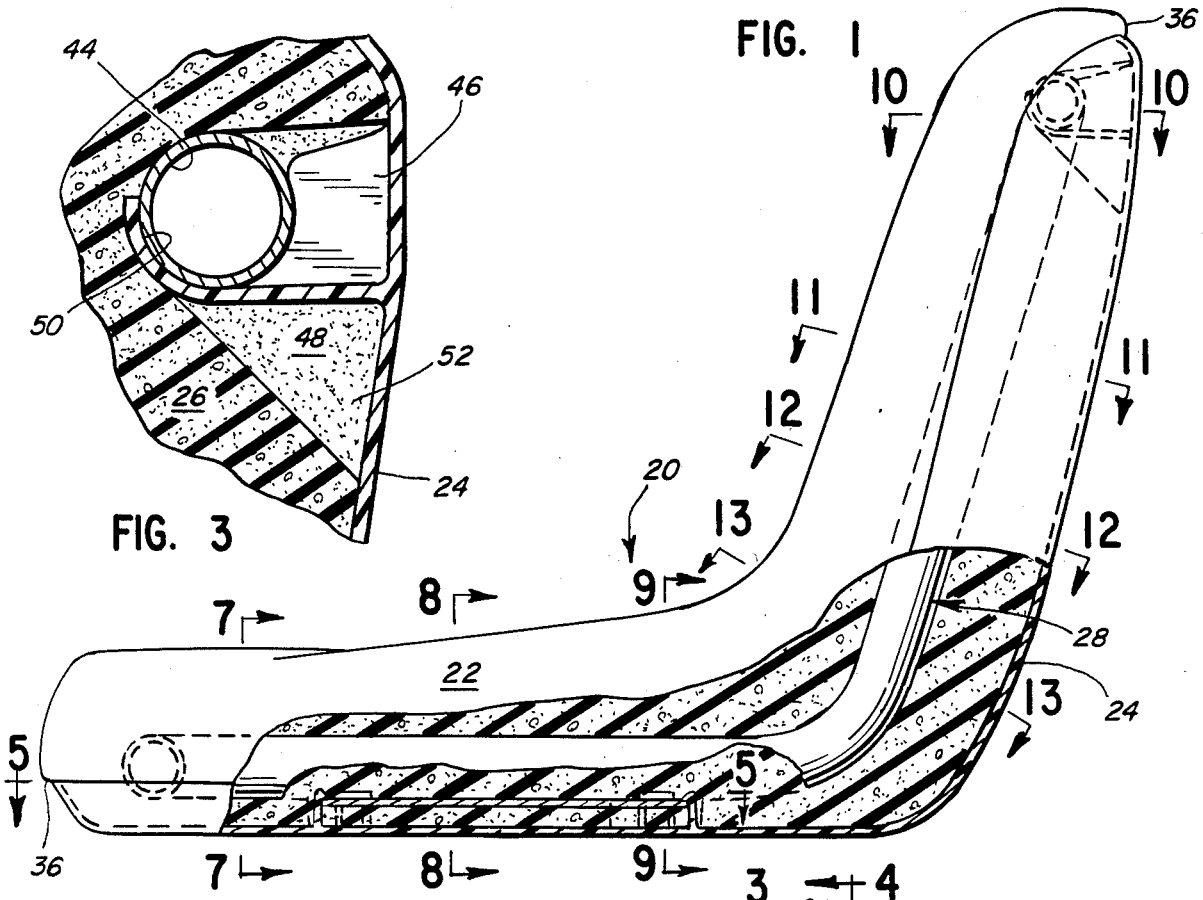
FIG. 1
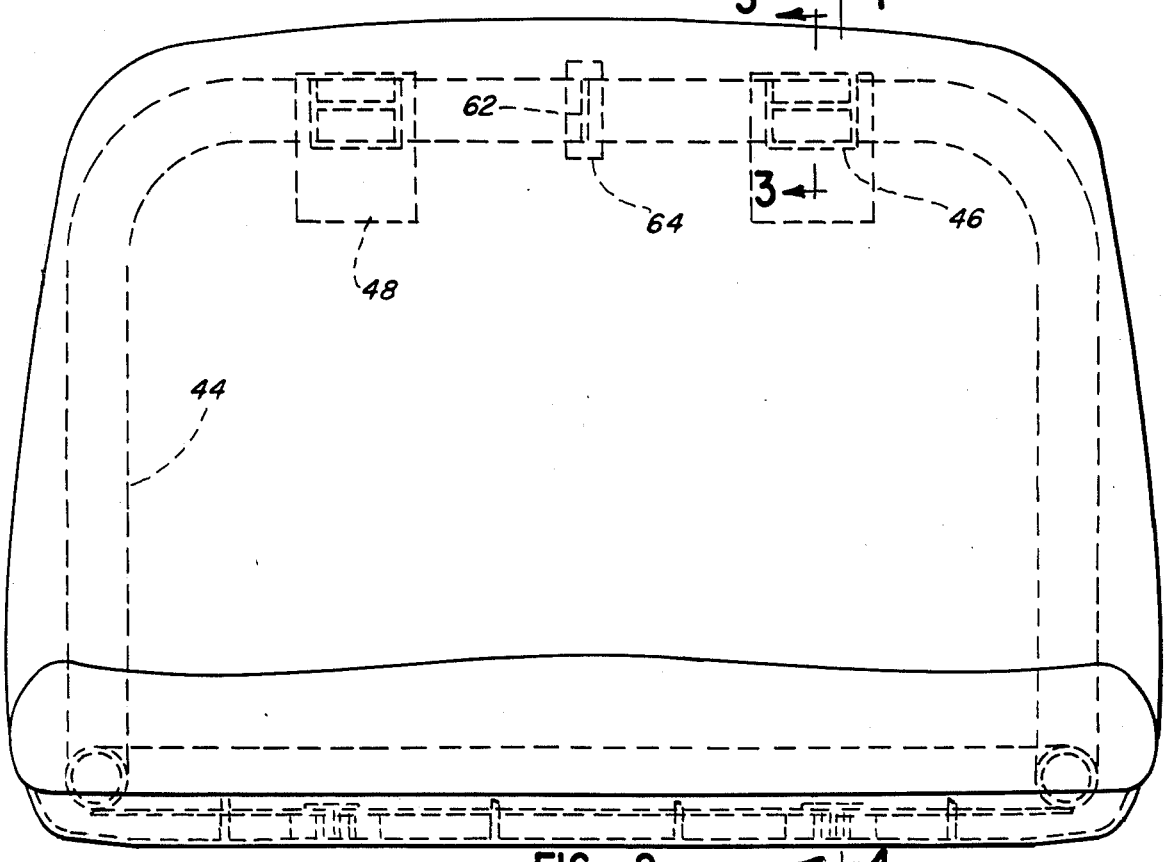
FIG. 2

SEAT ASSEMBLY

BACKGROUND OF THE INVENTION

The present invention relates to a novel seat assembly. More particularly, the invention is directed to a seat assembly that permits the fast and economical fabrication and assembly of an upholstered foam cushion to a rigid support shell. Such seat assemblies are commonly used in lawn and garden vehicles and in small recreational vehicles.

A wide variety of seat constructions are known in the art which incorporate an upholstered or covered foam cushion mounted to a rigid support shell. A common and well recognized problem associated with such seats is the relatively costly and labor intensive manufacturing step whereby the upholstery cover is trimmed and joined with the shell in a finished and aesthetically pleasing manner. Various prior art seat assemblies and methods of fabrication are described in U.S. Pat. Nos. 3,281,185; 3,298,743; 3,300,251; 3,328,085; 3,423,775; 3,521,929; 3,647,260; 3,713,697; 3,823,980; 3,904,242; 3,967,852; 4,018,479; and 4,357,723. Yet, none of the seat assemblies described in these patents incorporates a design that permits truly efficient and economical construction while remaining aesthetically pleasing.

SUMMARY OF THE INVENTION

The present invention overcomes the above described problems by providing a novel seat construction that permits simple and economical assembly. Moreover, the seat assembly has a clean and uncluttered "look" that is aesthetically appealing.

In accordance with the present invention, a seat assembly is provided having a cushion assembly, a rigid shell, a cover and means to maintain the cushion assembly, shell and cover in coupled juxtaposition. The cushion assembly includes a foam cushion and an internal rigid framework molded integrally within the foam cushion. The cushion has a side portion with a lip having a predetermined configuration, and the shell has a matching edge which aligns and mates with the cushion lip when the seat is assembled. In order to maintain the precise dimensions and shape of the cushion side portion and lip, the rigid framework is located within the cushion in close proximity to the side portion.

In accordance with the described embodiment of the invention, the rigid framework comprises a tubular member, the shell includes bracket means which rotatably engage the tubular member and the cushion includes access passages permitting engagement between the tubular member and the bracket means.

BRIEF DESCRIPTION OF THE DRAWINGS

The novel features of the invention are set forth in the appended claims. The invention itself, however, together with further objects and attendant advantages thereof, will be best understood by reference to the following description taken in connection with the accompanying drawings in which:

FIG. 1 is a side elevational view of a seat assembly constructed in accordance with the present invention;

FIG. 2 is a front view of the seat assembly shown in FIG. 1;

FIG. 3 is an enlarged, partial cross-sectional view taken along line 3—3 of FIG. 2 showing details of the rotatable mounting structure of the present invention;

DETAILED DESCRIPTION OF THE PREFERRED EMBODIMENTS

Figure 6:
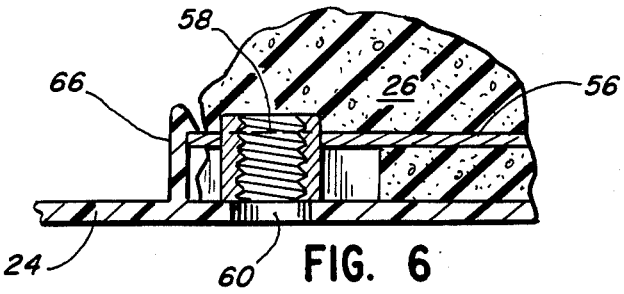
FIG. 6 is a further enlarged, cross-sectional view taken along line 6—6 of FIG. 5.
Figure 4:
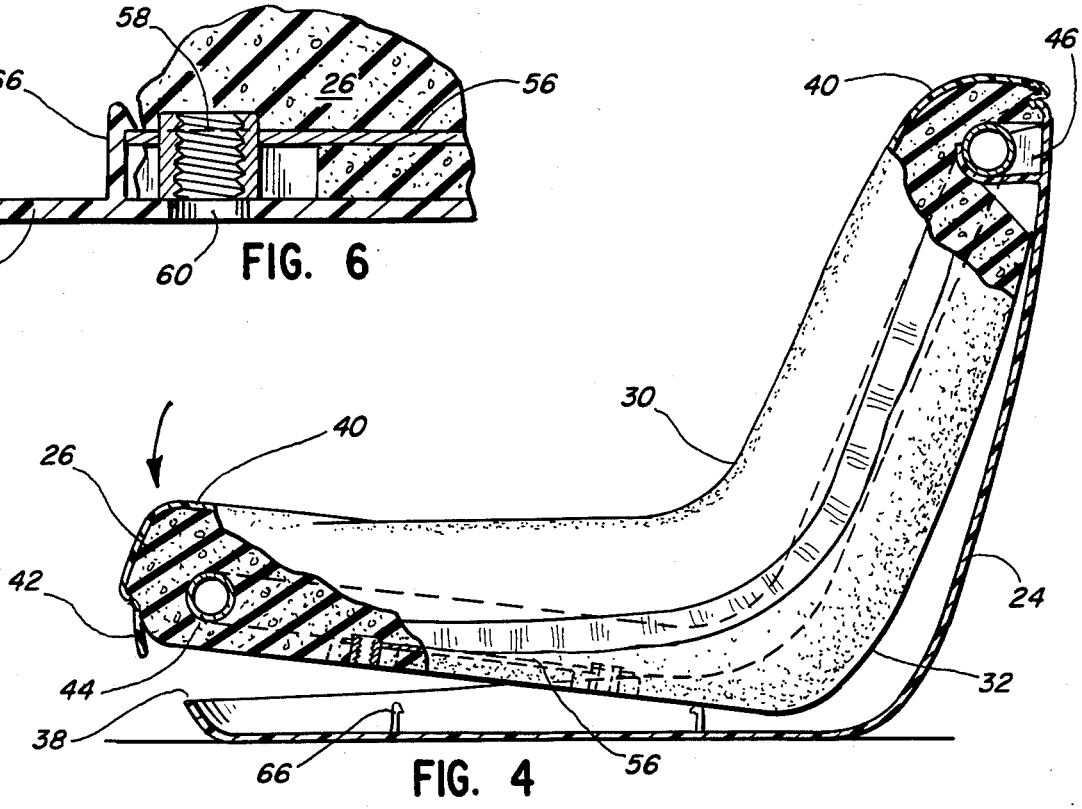
FIG. 4 is a partial cross-sectional view taken along line 4—4 of FIG. 2, but showing the cushion assembly as it is being rotated into final position during the manufacturing process.
Figure 5:
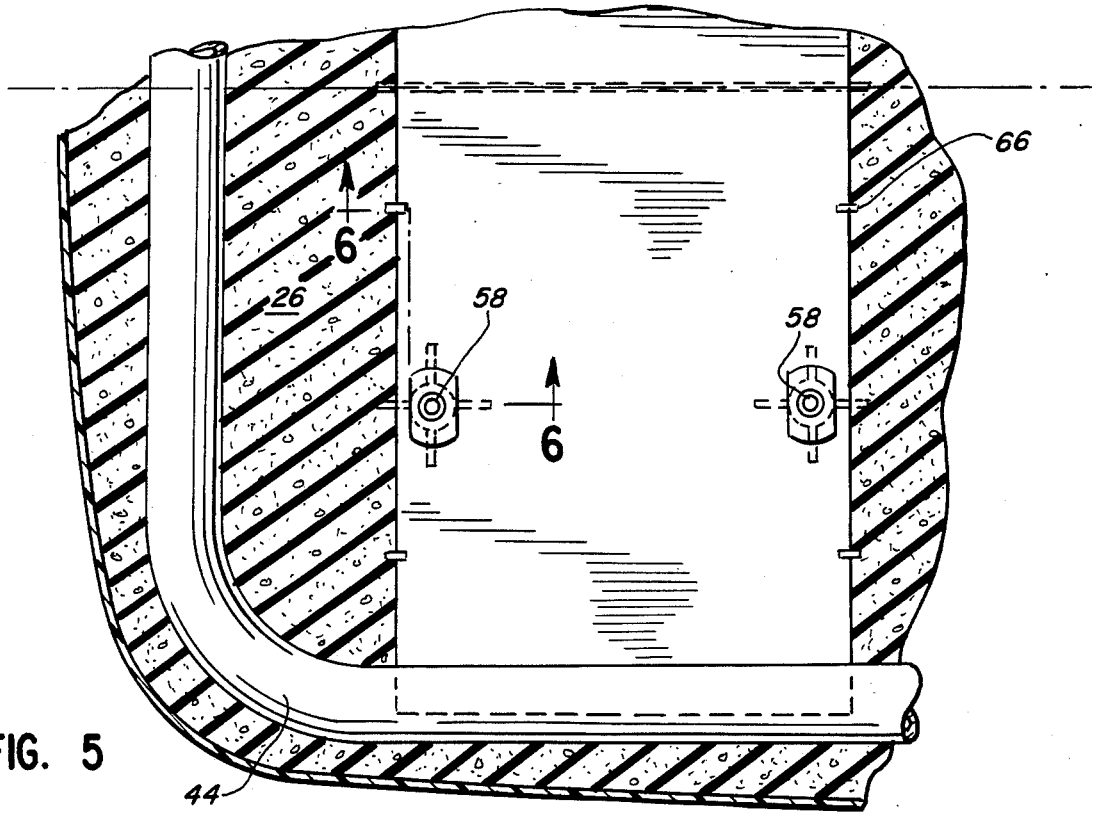
FIG. 5 is an enlarged, partial cross-sectional view taken along line 5—5 of FIG. 1 showing details of the internal framework construction.
Figure 7:
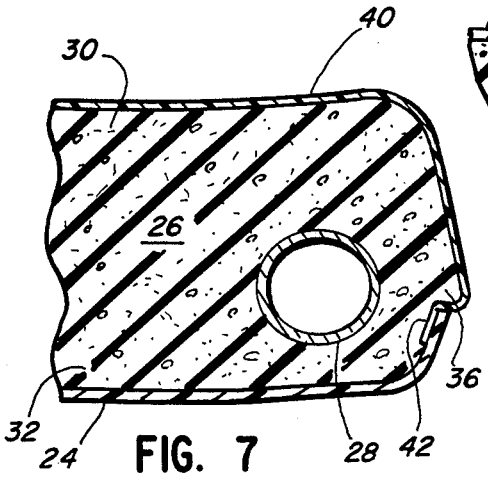
FIGS. 7 through 13 are all enlarged, cross-sectional views taken from FIG. 1, as indicated, and showing details of the internal framework, cushion, cover and shell at various points about the periphery of the seat assembly of FIG. 1.
Figure 10:
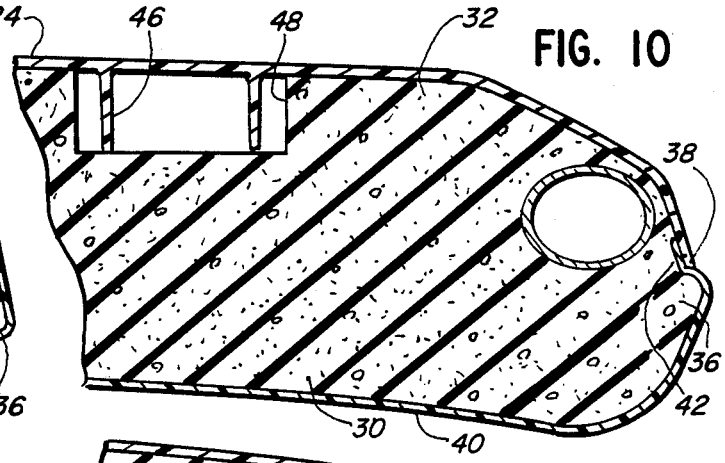
Figure 11:
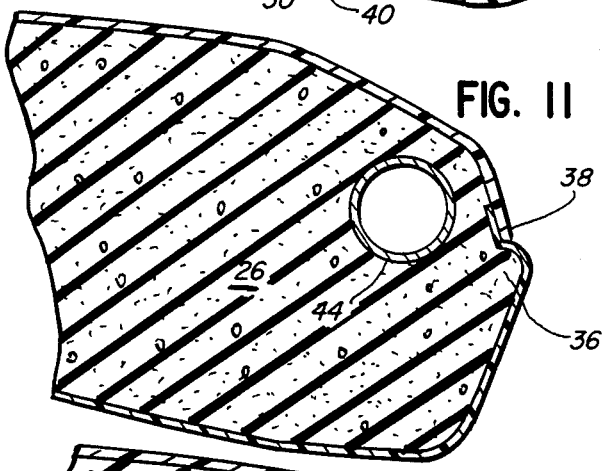
Figure 8:
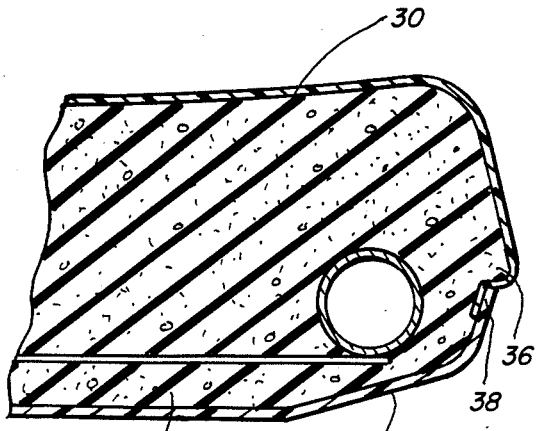
Figure 12:
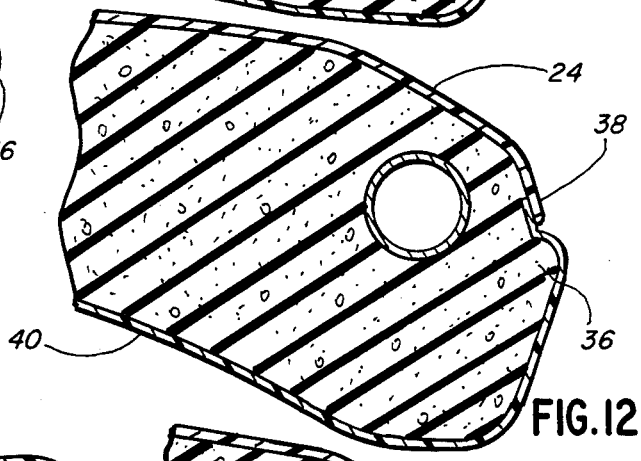
Figure 9:
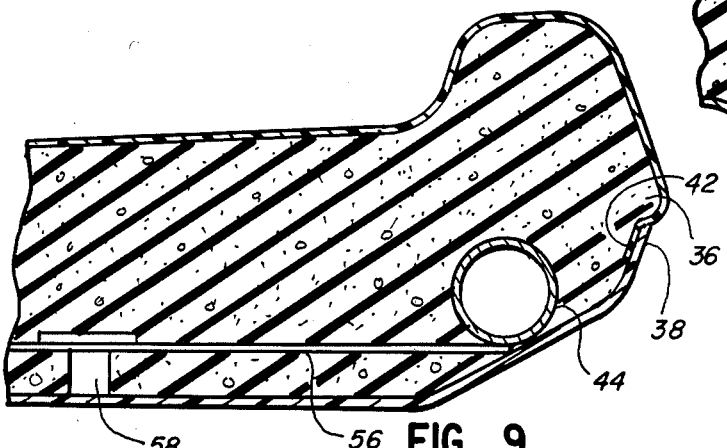
Figure 13:
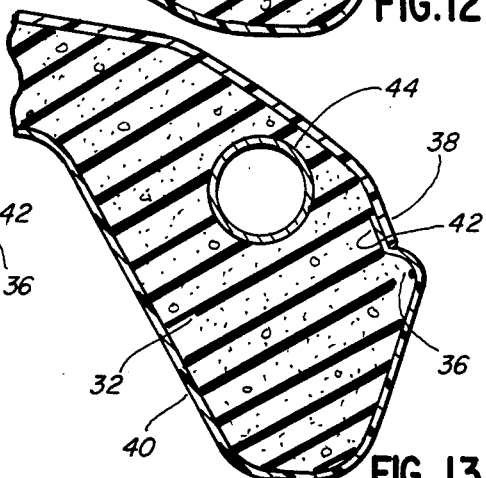

With reference to FIGS. 1, 2 and 4 of the drawings, a seat assembly, designated generally as 20, is shown having a cushion assembly 22 and a shell 24. The cushion assembly comprises a foam cushion 26 and a rigid internal framework 28 that is integrally molded within the cushion. The foam cushion includes front and back portions, 30 and 32 respectively, and a side portion 34 having a lip 36. The lip 36 extends entirely around the perimeter of the cushion 26 along the sides of the seat and backrest. Thus, the lip has a predetermined dimension and shape for any given seat design. The shell 24 is constructed from metal, plastic or other rigid material and includes a peripheral edge 38 configured to align and mate with cushion lip 36 when the shell is juxtaposed with the back portion of cushion 26.

The seat assembly of the present invention also includes a cover 40 comprising sheet vinyl, fabric or other conventional upholstery goods. The cover 40 overlies the front portion 30 of cushion 26 and is typically bonded to front portion 30 and part of the side portion 34 by any one of various techniques well known to those of skill in the art. The cover also includes a free peripheral section 42 that extends from the front portion of the cushion and between the lip 36 and shell edge 38. As a result, the free peripheral section 42 of the cover is mechanically retained between the shell 24 and cushion 26 when the seat assembly is completed.

In the illustrated preferred embodiment, the internal framework of the cushion assembly comprises a tubular member 44 which extends completely around the cushion 26 in close proximity to side portion 34 and lip 36. The purpose of the framework and tubular member 44 is to maintain the predetermined dimension and shape of the cushion lip 36 which would otherwise vary to an unacceptable degree because of the inherent dimensional variance in molded cushions of this size. In other words, there is an inherent shrinkage or shrink factor which exists in the foaming and molding process. This shrink factor can vary between 1 to 2 percent. The variance in shrink must be accommodated in any joint or interface between hard and soft goods. For example, on an 18 inch seat dimension the cushion shrink can vary from 0.18 to 0.36 inches. By foaming the cushion with the tubular structure in place, the shrinkage is limited to the area between the structure and the outside of the cushion. If this dimension is 1 inch the shrinkage range will amount to only 0.01 to 0.02 inches. This small variance (0.01 inches) is easily accounted for in the design of the seat. As a result, the interface between the cushion lip 36 and shell edge 38 is substantially uniform and aesthetically pleasing.

The tubular member 14 is positioned as close to the lip 36 as is possible without causing voids to form during molding and without being noticeable to the user or occupant of the seat. Thus, the precise spacing will vary depending upon the formulation of the foam used in cushion 26 and the shape of the cushion and shell 24. FIGS. 7–13 show a typical placement of the tubular member relative to the cushion side portion 34 and lip 36. While the tubular member 44 is spaced from the outer surface of the cushion 26, i.e. it is encapsulated by foam, it is nevertheless sufficiently close to side portion 34 in order to maintain the shape and dimensions of lip 36. Of course, it is also desirable to position the tubular member 44 close to the back portion 32 and away from the front portion 30 of the cushion.

As is shown most clearly in FIGS. 3 and 4, the cushion assembly is pivotally or rotatably mounted to shell 24. The shell 24 includes means for rotatably engaging the cushion assembly framework, such as brackets 46 which extend through passages 48 in cushion 26 and which rotatably support the tubular member 44 by means of upwardly opening bearings 50. Preferably, access passages 48 include an expanded rear opening 52 to facilitate insertion of brackets 46 and rotation of the cushion assembly to its final position where it nests within shell 24.

Framework 28 may also include plate 56 which bridges the framework across the seat of cushion 26. Plate 56 also includes fastening means, such as threaded fasteners 58, which align with holes 60 in shell 24. Thus, when the seat assembly is bolted to an underlying support via threaded fasteners 58, the cushion assembly is fixed in its final nested position within shell 24.

Other features illustrated in the preferred embodiment include the use of a force transmitting strut 62 which extends from the centerline of shell 24 to the tubular member 44 through passage 64. In this way, any force applied to the upper rear portion of the seat assembly will be transmitted directly to the framework and, via fasteners 58, to the vehicle frame. Also, temporary retaining elements 66 may be employed to engage plate 56 and hold the seat assembly in its assembled condition prior to installation into a vehicle.

Those skilled in the art will appreciate that the present seat design permits a much simpler and more cost efficient assembly than exists with prior art technology, and also results in a more aesthetic finished seat assembly.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

What is claimed is:

1. A seat assembly, comprising a foam cushion assembly including a foam cushion and a rigid internal framework molded integrally within said cushion, said cushion having front, back and side portions and a lip extending entirely around said side portion, said framework being located within said cushion in sufficient proximity to said side portion to substantially maintain the shape, size and configuration of said side portion and said cushion lip;

a rigid shell in juxtaposition with the back portion of said cushion, said shell having bracket means for rotatably engaging said cushion assembly framework, said shell also having a peripheral edge configured to substantially uniformly align and mate with said cushion lip;

a cover member overlying the front portion of said cushion and having a free peripheral section extending between said cushion lip and said shell edge; and means to maintain said shell and foam cushion in coupled justaposition and to thereby hold the peripheral section of said cover between said cushion lip and said shell edge.

2. The seat assembly of claim 1 wherein said internal framework comprises a tubular member, said cushion includes two passages permitting access to said tubular member from the back portion of said cushion, and said shell bracket means includes two brackets aligned to extend into said passages, each of said bracket terminating in an upwardly opening bearing for receiving and rotatably engaging said tubular member.

3. The seat assembly of claim 1 wherein said internal framework includes a base plate having integral fastening means and said shell includes apertures aligned with said fastening means.

* * * * *

UNITED STATES PATENT AND TRADEMARK OFFICE

CERTIFICATE OF CORRECTION

PATENT NO. : 4,792,189

DATED : December 20, 1988

INVENTOR(S) : John S. Shovar

It is certified that error appears in the above-identified patent and that said Letters Patent is hereby corrected as shown below:

On the title page, the following should be inserted to read as follows:

--[73] Assignee: Sears Manufacturing Co., Davenport, Iowa--.

Signed and Sealed this

Fifteenth Day of May, 1990

*Attest:*

HARRY F. MANBECK, JR.

*Attesting Officer*

*Commissioner of Patents and Trademarks*